US006442762B1

(12) United States Patent
Neumann

(10) Patent No.: US 6,442,762 B1
(45) Date of Patent: Sep. 3, 2002

(54) CHIN STRAP FOR A CAP AND COMBINATION THEREOF

(76) Inventor: Eric W. Neumann, 8411A Crystal Springs Rd., Woodstock, IL (US) 60098

( * ) Notice: Subject to any disclaimer, the term of this patent is extended or adjusted under 35 U.S.C. 154(b) by 0 days.

(21) Appl. No.: 09/657,024

(22) Filed: Sep. 7, 2000

(51) Int. Cl.[7] ..... A42B 7/00
(52) U.S. Cl. ..... 2/175.7; 2/209.13; 132/58
(58) Field of Search ..... 2/175.1, 195.1, 2/209.13, 421, 175.7; 24/3.11, 3.13, 115 H, 298, 115 G, 300, 563; 132/58

(56) References Cited

U.S. PATENT DOCUMENTS 853,121 A * 5/1907 Saundry ..... 132/58
867,814 A * 10/1907 Fornander ..... 2/175.7
1,481,541 A * 1/1924 Douglas ..... 2/175.7
4,841,576 A * 6/1989 Beagley ..... 2/189
4,991,236 A * 2/1991 Pritchett ..... 2/189
5,144,695 A * 9/1992 Schweizer ..... 2/189
5,355,535 A * 10/1994 Bruder ..... 2/172
5,611,118 A * 3/1997 Bibbee ..... 24/298
5,803,266 A * 9/1998 Blackwelder ..... 206/575
5,933,871 A * 8/1999 Kraft ..... 2/209.13
6,189,186 B1 * 2/2001 Boden ..... 24/129 R

* cited by examiner

*Primary Examiner*—Peter Nerbun
*Assistant Examiner*—Katherine Moran
(74) *Attorney, Agent, or Firm*—Charles F. Meroni, Jr.; Meroni & Meroni, P.C.

(57) ABSTRACT

A chin strap which can be used to retrofit an existing head covering so as to provide a means to retain the head covering on the wearer's head without damage to or modification of the head covering. The chin strap is an elongate strand and is provided with a clip at each end. The clips are used to secure the elongate strand to the interior band of the head covering by attachment of a clip on both the left and right side of the interior band. The clip slips over the interior band and is maintained in place by means of clip spring tension. The elongate strand extends between the two clips and is provided in a length which allows generous slack. The amount of slack in the chin strap is adjusted to the comfort of the wearer using a bead or adjustment clip mounted in the mid portion of the elongate strand. The bead or adjustment clip may be imprinted with a logo or trademark so that the chin strap may be used as an advertisement or promotional item. The chin strap is provided with a novel packaging card which simultaneously presents the invention and illustrates its use. A kit is described which includes the components of at least one unassembled chin strap.

29 Claims, 6 Drawing Sheets

480
492
494
489
487
484
498
32
30

480
490
494
492
32
487
498
30
80
156
80
159
154
10
30
146
142
140
146
140
LOGO
144
148

10
30
244
240
242

CHIN STRAP FOR A CAP AND COMBINATION THEREOF

BACKGROUND OF THE INVENTION

The present invention relates generally to chin straps for head coverings. Specifically, the present invention relates to a chin strap which can be added to retrofit any cap or hat having an interior band in the base of the crown.

Hats and caps come in a multitude of shapes and styles which vary with intended use and with the wearer's sense of fashion. Although intended to protect the wearer's head from the elements and shield the wearer's eyes from the glare of the sun, often these head coverings are provided with no means for retaining the covering on the wearer's head. It is important to be able to retain a hat or cap in place especially for persons wearing a head covering during vigorous activities such as walking, biking, or playing tennis and golf. It is equally important for persons who want to maintain their head covering in place while out in strong winds or while riding in fast moving vehicles such as boats or convertible cars. Thus, it is very advantageous to be able to add a chin strap to head coverings which are not originally fabricated with one permanently attached. For instance, a classic baseball cap is used not only by ballplayers but also by active adults and children in a wide variety of activities. A baseball cap is not provided with any means of retaining the cap on the head or near the body in the event of a gust of wind or a sudden motion by the wearer.

SUMMARY OF THE INVENTION

The present invention is a chin strap which can be used to retrofit an existing head covering so as to provide a means to retain the head covering on the wearer's head. The inventive chin strap is secured to the interior band of the head covering by means of a clip mounted at each end of the strap portion. The clip slips over the interior band and is maintained in place by means of clip spring tension. A clip is mounted on both the left and right side of the interior band and the strap portion extends between the two clips. The strap portion is provided in a length which allows generous slack. The amount of slack in the strap portion is adjusted to the comfort of the wearer using a bead or adjustment clip mounted in the mid portion of the strap portion.

It is an object of this invention to provide a chin strap which can be easily and quickly attached to and detached from any head covering which is constructed with an interior band. Each of the two ends of the chin strap are provided with a clip, and the clips are secured to the interior band without modification of or damage to the head covering.

It is an object of this invention to provide a chin strap having clips for attaching to the interior band of a head covering, where the clips are flat in profile and without sharp edges or protrusions so as to be comfortable for the wearer.

It is an object of this invention to provide a chin strap having clips for attaching to the interior band of a head covering, where the clips are provided with a width which minimizes pivoting of the clips on the interior band while in use.

It is an object of this invention to provide a chin strap which is adjustable.

It is an object of this invention to provide a chin strap wherein the means for adjustment is provided with at least one surface which is sized to allow the imprint of a logo or trademark so that the chin strap can be used as an advertising or promotional item.

It is an object of this invention to provide a chin strap wherein the means for adjustment is provided with at least one surface which is sized to allow decoration or customizing so that the chin strap can be used as a clothing accessory or as an ornamental item.

It is an object of this invention to provide a chin strap which incurs minimal manufacturing costs and is simple to assemble.

It is an object of this invention to provide a chin strap which is combined with a novel packaging card, the combination chin strap and packaging card simultaneously showing the purchaser the product and illustrating its use on a hat or cap.

It is an object of this invention to provide a chin strap kit wherein the components which comprise the inventive chin strap are provided unassembled, allowing the user to create their own chin strap, for use as a craft or hobby item.

DETAILED DESCRIPTION OF THE INVENTION

The inventive chin strap can be used to retrofit any existing head covering that is fabricated with an interior band within the crown. The chin strap will be described below as being used with a baseball cap, but it is well within the scope of the invention to use the inventive chin strap with any style head covering.

Figure 1:
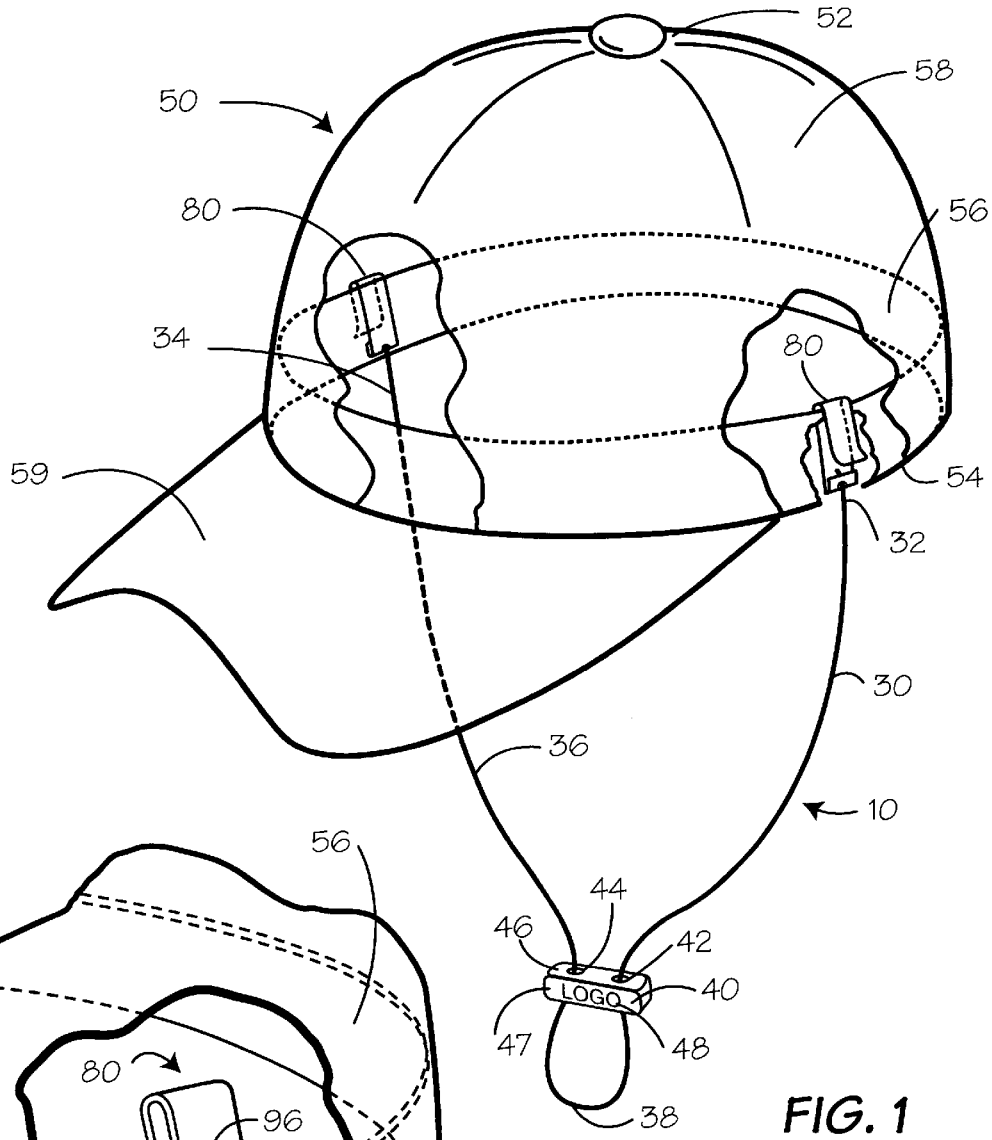
FIG. 1 is a front perspective view of the chin strap mounted on a cap with the cap partially cut away in the region of the clip to illustrate how the clip attaches to the interior band.
Figure 2:
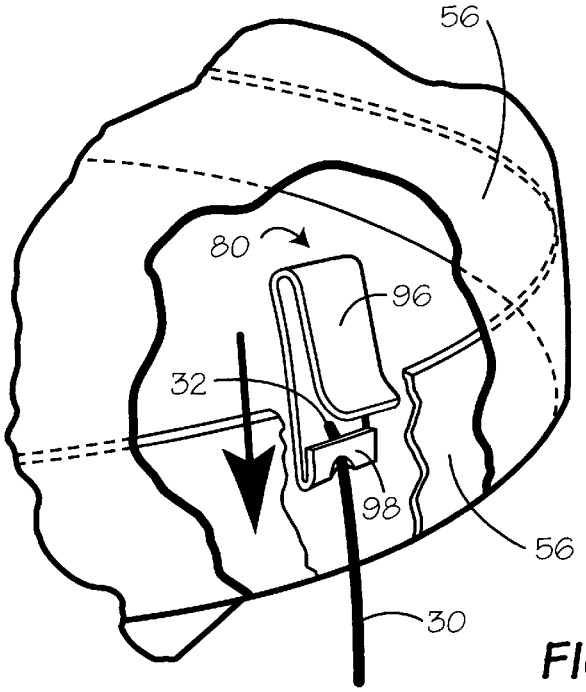
FIG. 2 is a partial perspective view of the cap showing detail of the cap interior band and attachment of the clip thereon, the directional arrow showing how the clip is slipped downward over the interior band of the cap.
Figure 5:
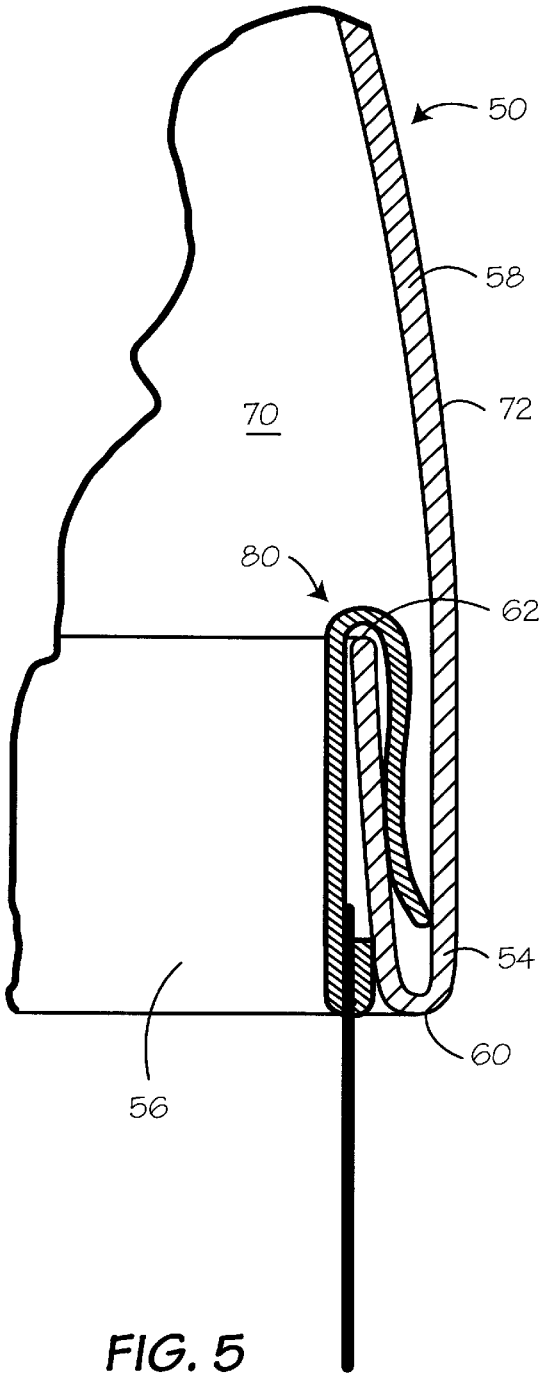
FIG. 5 is a partial perspective view of the base of the cap and side sectional view of the clip mounted within the cap, illustrating the relationship of the clip to the interior band when the clip is mounted on the interior band.

In general, cap 50, shown in FIGS. 1, 2, and 5, is fabricated having a crown 58 and a visor 59, where the crown 58 is generally hemispherical in shape. The crown 58 has a hollow interior, this hollow interior being the portion of the cap which fits about the upper portion of the head of the wearer 5. The crown 58 has an interior surface 70 and an exterior surface 72, and is provided with an apex 52 and a generally circular base 54.

The crown 58 of the cap is also provided with an interior band 56 which results from the inward folding of the peripheral edge of the crown. The interior band 56 extends upward toward the apex 52 and overlies and confronts the interior surface 70 of the crown 58 adjacent to the circular base 54.

The interior band 56 has a terminal or free edge 62 and a fold edge 60, wherein the fold edge 60 of the interior band 56 consists of the portion of the crown 58 which corresponds to the folding of the peripheral edge of the crown 58. The exterior surface 72 of the crown 58 immediately adjacent to the fold edge 60 defines the generally circular base 54.

The interior band 56 terminates within the hollow interior of the crown 58 at the free edge 62, the free edge 62 being adjacent to but spaced apart from the fold edge 60. This spacing of the free edge 62 and the fold edge 60 defines the height of the interior band 56.

Figures 12, 13, 14, 14A, 15:
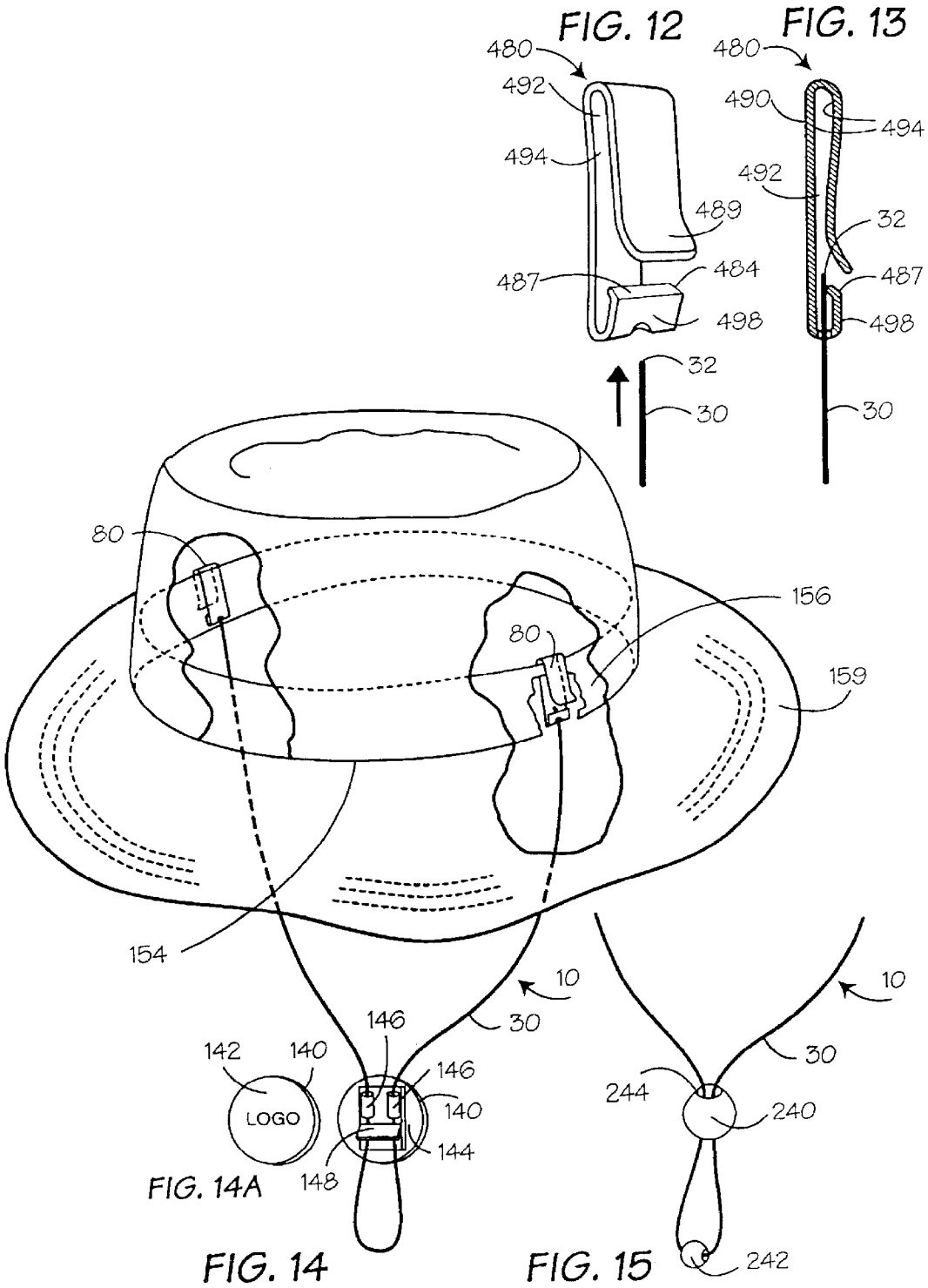
FIG. 12 is a perspective view of a second embodiment of the clip illustrating the folded shape of the clip body and the through hole in the lower fold which receives the strap material, the arrow indicating the direction of insertion of the strap material into the through hole during fabrication.
FIG. 13 is a side sectional view of the second embodiment of the clip illustrating the strap material fully inserted into the through hole in the lower fold, and the modified lower flange crimped against the body portion of the clip to retain the strap material within the lower flange and prevent it from retracting from the through hole.
FIG. 14 is a front perspective view of the chin strap mounted on a hat having a full brim, with the hat partially cut away in the region of the clip to illustrate how the clip attaches to the interior band, illustrating that the inventive chin strap may be used on a variety of head coverings, and also showing a rear view of an alternative means for adjusting the slack in the chin strap.
FIG. 14A is a front view of the alternative means for adjusting the slack in the chin strap illustrated in FIG. 14, illustrating how a logo or other decorative indicia may be employed thereon.
FIG. 15 is a partial view of the chin strap illustrating a second alternative means for adjusting the slack in the chin strap.

Cap 50 is provided with a visor 59 which extends laterally outwardly from a portion of the exterior surface 72 of the generally circular base 54 of the crown 58. When cap 50 is worn, the visor 59 is placed adjacent to the forehead of the wearer 5, and is intended to shield the wearer's eyes from the sun and other weather elements. Other styles of head coverings are provided with additional visors or a brim 159, where a brim is a lateral outward extension which completely surrounds the generally circular base 154 (FIG. 14). It is understood that the inventive chin strap 10 can be used with any style of head covering regardless of the size and style of the visor 59 or brim 159, as long as the head covering is fabricated having an interior band 56, 156.

As illustrated in FIG. 1, chin strap 10 comprises an elongate flexible strand 30 of material having a first end 32, a second end 34, and a mid portion 36 which extends between the first end 32 and the second end 34. In the preferred embodiment, strand 30 is formed from a durable natural or synthetic twine. It is well within the scope of the invention, however, to form strand 30 from another material or combination of materials which include, but are not limited to, leather, wire, chain, plastic, strings of beads, webbing, etc. The material chosen must meet the utilitarian requirements of having a moderate tensile strength, but may also be provided in a wide range of decorative styles to meet any aesthetic requirements of the wearer 5.

Figure 8:
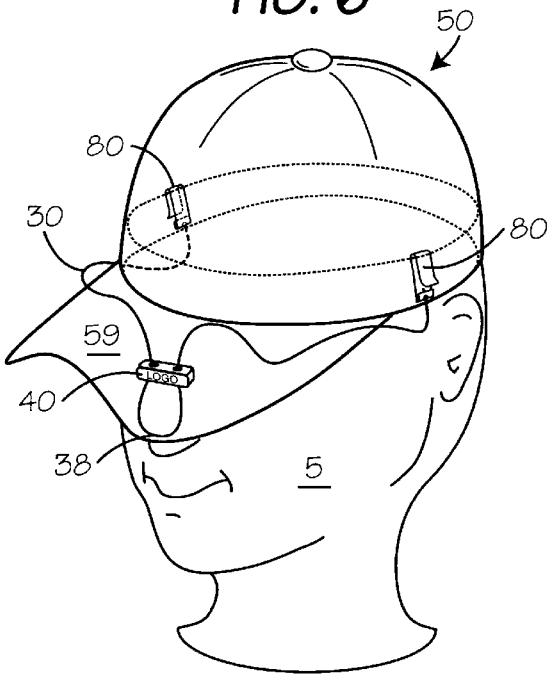
FIG. 8 is a front perspective view of the cap and chin strap, illustrating a third possible wearing configuration wherein the chin strap is placed upon the upper side of the cap visor.

In the preferred embodiment, strand 30 is formed having a diameter of approximately 2 mm and an approximate length of 20 inches. This length was determined to be optimal for use by an average adult since it was long enough to allow the wearer 5 to easily pass chin strap 10 over the head, but was also short enough to be easily stored on visor 59 without overhang, as shown in FIG. 8. It is within the scope of the invention, however, to vary these dimensions to accommodate different material selections and to achieve different visual effects. Additionally, length of strand 30 may be varied to accommodate different sized users. For example, a shorter length may be required for a younger wearer.

Figure 3:
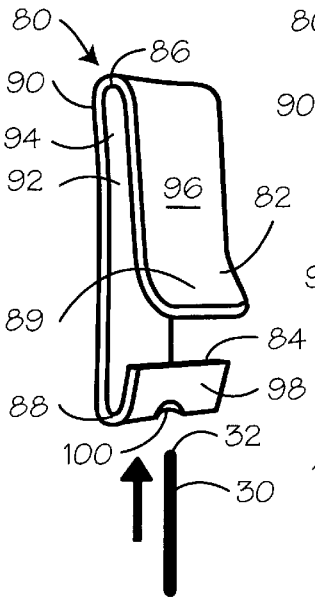
FIG. 3 is a perspective view of the preferred embodiment of the clip illustrating the folded shape of the clip body and the through hole in the lower fold which receives the strap material, the arrow indicating the direction of insertion of the strap material into the through hole during fabrication.
Figure 4:
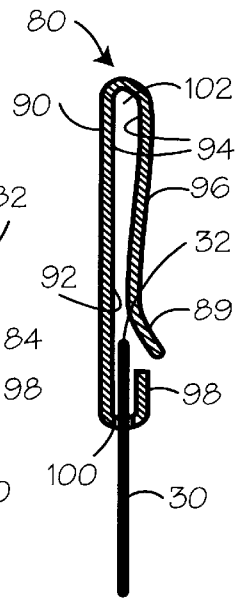
FIG. 4 is a side sectional view of the preferred embodiment of the clip illustrating the strap material fully inserted into the through hole in the lower fold, and the lower flange crimped against the body portion of the clip to retain the strap material within the lower flange and prevent it from retracting from the through hole.

Each respective first end 32 and second end 34 of chin strap 10 is secured to the interior band 56 by means of a clip 80 (FIGS. 3, 4). Clip 80 is comprised of an elongate sheet of material, the elongate sheet having a narrow width relative to its length, and a thickness which is small relative to its length and width. The elongate sheet has a first end 84, a second end 82, and a body portion 92 which extends along the length between the first end 84 and the second end 82. The body portion 92 of the elongate sheet is provided with an inner surface 94 and an outer surface 90. In the preferred embodiment, clip 80 is formed from metal, most preferably steel. It is, however, well within the scope of the invention to form clip 80 from other materials, which include, but are not limited to, plastics and composite materials. The material selected must be capable of being formed into the desired shape, provide some spring tension when slightly deformed, and be corrosion resistant. Additionally, clip 80 may be fabricated as a metal form having a plastic coating so as to provide clip 80 with protection against corrosion and to give increased comfort to the wearer 5.

Body portion 92 of clip 80 is formed having a first fold 88 adjacent to but spaced apart a first distance from the first end 84, the first fold 88 resulting in the first end 84 being folded back so as to overlie and confront the inner surface 94 of the body portion 92 to form a first flange 98.

Body portion 92 of clip 80 is formed having a second fold 86 adjacent to but spaced apart a second distance from the second end 82, the second fold 86 resulting in the second end 82 being folded back so as to overlie and confront the inner surface 94 of the body portion 92 to form a second flange 96, the second distance being sized such that the second end 82 generally abuts the first end 84.

Body portion 92 is provided with a through hole 100 which extends between the inner surface 94 and the outer surface 90, such that it coincides with the first fold 88. Through hole 100 is dimensioned to fittingly receive one of the respective first or second ends 32, 34 of the strand 30 therethrough. Strand 30 is retained between first flange 98 and the inner surface 94 of the body portion 92 by crimping the first flange 98 and inner surface 94 together with strand 30 sandwiched therebetween. In an alternative embodiment (FIGS. 12 and 13), first end 484 is provided with an inward bend 487 along its entire width such that the first end 484 is angled inward toward the inner surface 494 of the body portion 492. Inward bend 487 is intended to provide additional gripping of the end 32, 34 of strand 30 to ensure retention of the strand 30 within the clip 480.

Second end 82 of body portion 92 is provided with an outward bend 89 along its entire width such that second end 82 is spaced apart from both the inner surface 94 of the body portion 92 and from the first end 82. Outward bend 89 allows the second flange 96 to be easily inserted between the interior band 56 and the inner surface 70 of the crown 58 and also serves to guide the free edge 62 of the interior band 56 into the recess 102 between the second flange 96 and the inner surface 94 of clip 80. When in use, the interior band 56 of cap 50 is maintained between the second flange 96 and the body portion 92 of clip 80 by means of spring tension. This spring tension results from the slight deflection of second flange 96 away from body portion 92 due to the insertion of interior band 56. This spring tension is adequate to fully retain clip 80 on interior band 56, but does not damage or modify cap 50 in any way.

Clip 80 is provided in a width that is optimized to minimize pivoting of clip 80 about interior band 56 when in use and to optimize comfort for the wearer 5. In the preferred embodiment, clip 80 has a finished overall length of approximately 1.125 inches and overall width of approximately 0.375 inches. In this embodiment, first flange 98 has an approximate length of 0.25 inches, and second flange 96 has an approximate length of 0.875 inches. These dimensions have been determined to provide a clip 80 which fits a typical adult cap 50. It is well within the scope of this invention, however, to provide clip 80 with dimensions which vary from those described above. For example, the dimensions of clip 80 may be scaled down to accommodate youth and infant sized head coverings, or may be scaled up to accommodate head coverings of different styles or different interior band widths.

Mid portion 36 of strand 30 extends between the two clips 80. Mid portion 36 is provided in a length which allows generous slack. This slack allows chin strap 10 to be easily and comfortably placed over the wearer's head 5 when dressing and when in use. The amount of slack in the mid portion 36 is adjusted to the comfort of the wearer by an adjustment means such as a bead 40 mounted in the mid portion 36. The adjustment means varies the slack in strand 30, or the shortest distance along strand 30 between first end 32 and second end 34, by gathering together and securing a section of mid portion 36. As shown in FIG. 1, the greater the distance of strand center 38 from the adjustment means (shown as bead 40), the less slack in strand 30. Conversely, the greatest possible slack in strand 30 will be obtained when the adjustment means has gathered and secured a minimal section of mid portion 36, as when strand center 38 is adjacent to the adjustment means.

Bead 40 is provided with at least two through holes 42, 44. Strand 30 is serially laced through each hole 42, 44 such that the mid portion 36 of strand 30 resides within said bead. Bead 40 is preferably formed from plastic, but it is within the scope of the invention to form bead 40 from other materials which include, but are not limited to, bone, stone, metal, glass, and leather. Bead 40 is illustrated in FIGS. 1 and 6–10 as rectangular in shape, but may be provided in other shapes, which include, but are not limited to, spherical, elliptical, disk, and irregular. The exterior surface 46 of bead 40 may be smooth or rough, planar or contoured, or combinations thereof. The appearance of bead 40 can be varied to suit a variety of targeted consumers. In the preferred embodiment, the exterior surface 46 of the bead 40 is provided with at least one exterior surface portion 47 which is formed of a length and width which is sized to allow indicia 48 to be imprinted thereon. In this way, the imprint of a logo or trademark can be prominently displayed on chin strap 10 so that chin strap 10 can be used as an advertising or promotional item.

Although bead 40 is the preferred means of adjustment, it is well within the scope of this invention to use other adjustment means which are well known in the art. An example of other adjustment means includes, but is not limited to, first alternative adjustment clip 140. Adjustment clip 140, illustrated in FIG. 14, is similar to a bolo tie clip and is comprised of a flat disk having a first face 142 which is decorative and may concurrently be used to present an advertisement or logo. Adjustment clip 140 has a second face 144, opposed to first face 142, which has two channels 146 formed thereon to receive strand 30. Compression bar 148 is adjacent to channels 146 and is used to maintain the position of strand 30 in channels 146.

A second alternative adjustment means 240, 242 is illustrated in FIG. 15. Primary bead 240 is provided with a single through hole 244. Strand 30 is inserted through single through hole 244 in a first direction and then is passed through a secondary bead 242. Strand 30 is then reinserted through single through hole 244 of primary bead 240 in a second direction, where the second direction is opposed to the first direction. Strand 30 is prevented from completely disengaging from primary bead 240 because secondary bead 242 is sized to be larger than the diameter of single through hole 244.

Figure 6:
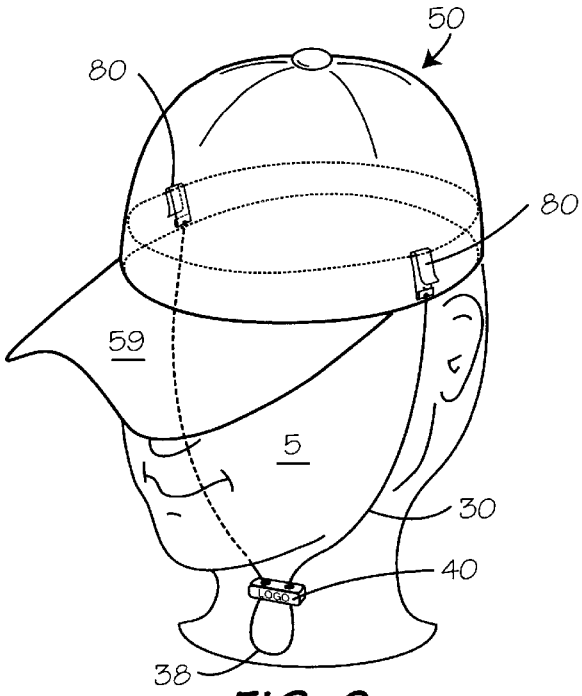
FIG. 6 is a front perspective view of the cap and chin strap, illustrating the preferred wearing configuration wherein the chin strap is placed under the wearer's chin.

In use, chin strap 10 is retrofitted to the head covering by mounting each clip 80 to the interior band 56 of the head covering such that each clip 80 is located at the lateral side of the head covering corresponding to the region adjacent to the wearer's ears. Note that when attached correctly, the smooth, flat outer surface 90 of clip 80 lies facing the wearer's head, so that the presence of the clips on cap 50 is not noticeable to the wearer. FIG. 6 illustrates the preferred mode of using chin strap 10 with cap 50. In this figure, chin strap 10 extends downward from cap 50 such that center 38 of mid portion 36 of strand 30 is positioned generally below the wearer's chin. Bead 40 is adjusted along strand 30 to take up the slack in an amount which depends on the comfort of the wearer and environmental conditions, noting that chin strap 30 need not be adjusted tightly for effective function. That is, bead 40 may need to be adjusted close to the wearer's chin and neck to minimize slack in severe wind conditions, However, the same user may prefer a more loose adjustment in milder conditions, allowing bead 40 to rest lower on the neck.

Figure 7:
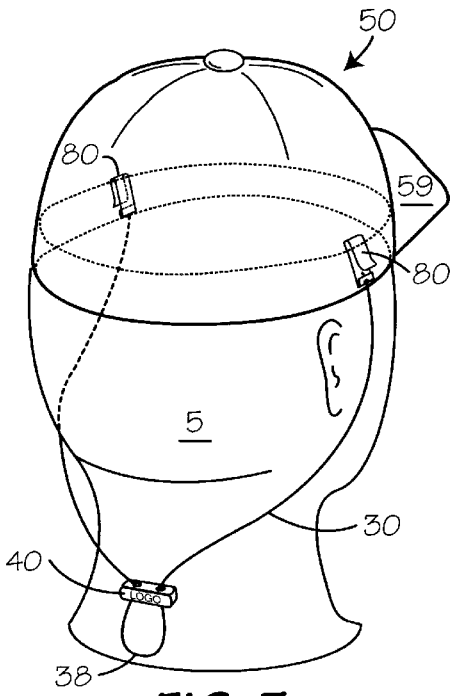
FIG. 7 is a rear perspective view of the cap and chin strap, illustrating a second possible wearing configuration wherein the chin strap is placed behind the wearer's head so as to rest on the back of the neck.
Figure 9:
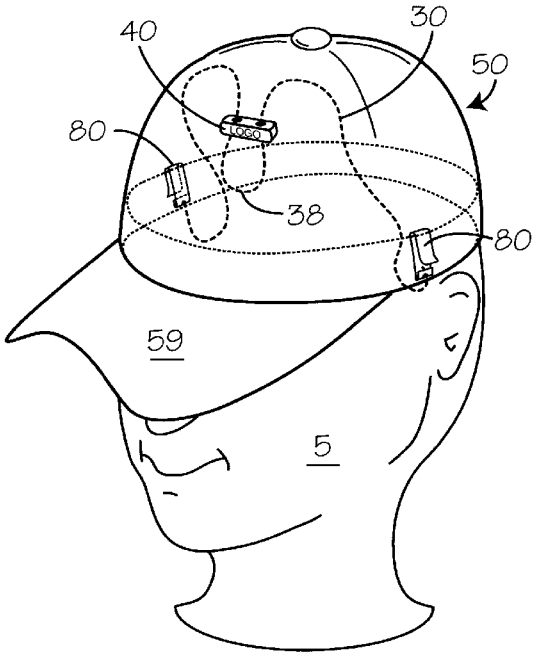
FIG. 9 is a front perspective view of the cap and chin strap, illustrating a fourth possible wearing configuration wherein the chin strap (shown in phantom) is placed within the crown of the cap.

FIGS. 7–9 illustrate alternative modes of using chin strap 10 with cap 50. These modes are consistent with storing chin strap 10 when its use is not required, or with using chin strap 10 as a clothing accessory or decoration. These figures illustrate that detachment of chin strap 10 is not required when it is not in use. In FIG. 7, mid portion 36 extends downward from cap 50 such that center 38 of mid portion 36 is positioned behind the wearer's head such that bead 40 is located adjacent the back of the wearer's neck. FIG. 8 illustrates the mid portion 36 of strand 30, including bead 40, resting on the upper portion of visor 59. The configurations of FIG. 7 and FIG. 8 allow chin strap 10 to be maintained out of the way of the wearer and or to be worn as a decorative accessory. FIG. 9 illustrates the mid portion 36 of strand 30, including bead 40, tucked up within the crown 58 of cap 50.

Figure 10:
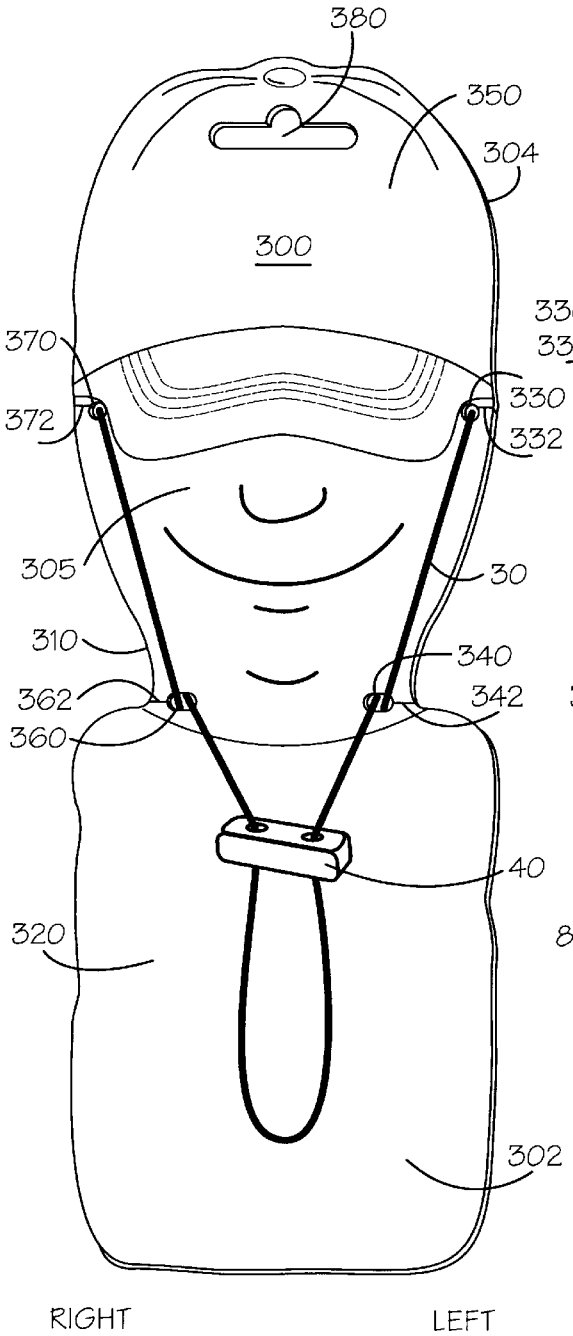
FIG. 10 is a front view of the chin strap mounted on a packaging card, the indicia on the card showing a human head, neck, and partial human shirt and showing a cap being worn on the head, the chin strap being mounted on the packaging card in a manner which illustrates its function.
Figure 11:
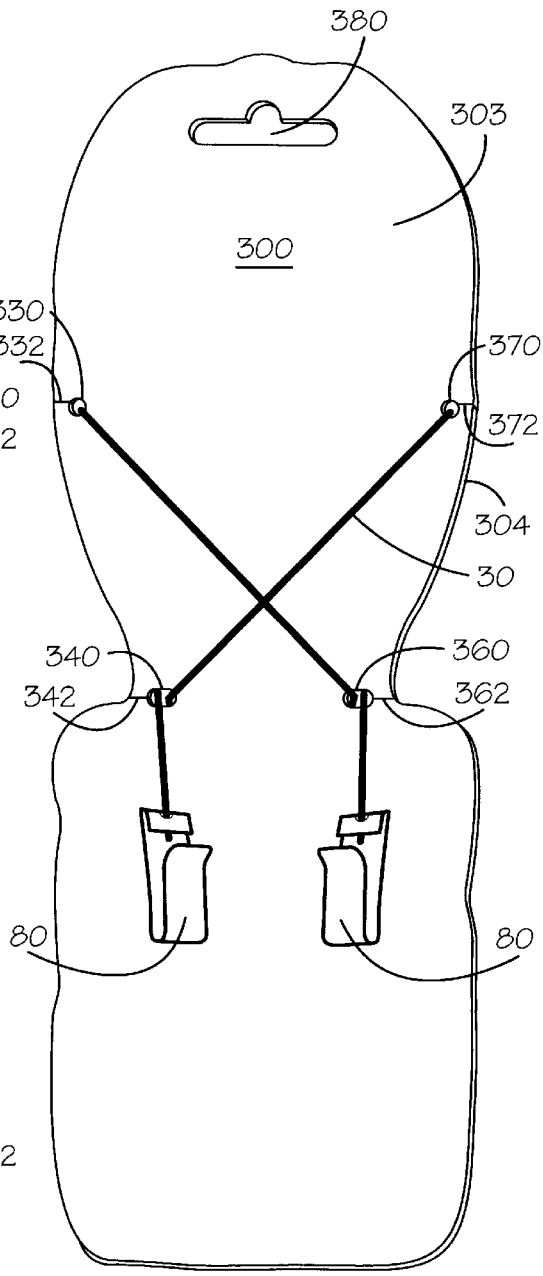
FIG. 11 is a rear view of the chin strap mounted on the packaging card of FIG. 10, illustrating the plurality of holes and slits perforating the card to allow the chin strap to be mounted to the card in the preferred manner.

Chin strap 10 will be presented using a novel packaging card 300 as illustrated in FIGS. 10 and 11. Rigid packaging card 300 is provided with a front surface 302, a back surface 303, and with a shaped peripheral edge 304 which corresponds to the outline of a human head, human neck and a portion of a human torso adjacent to said neck, and includes the outline of a head covering on the human head. The front surface 302 is provided with indicia in the form of a human face 305, indicia in the form of a cap 350 mounted on the head above the face 305, indicia in the form of a human neck 310 extending below the face 305, and indicia in the form of a partial human shirt 320 extending below the neck 310. For the purposes of illustration, the indicia in the form of a cap 350 is shown herein as a baseball cap. It is understood, however, that indicia in the form of a cap 350 may also be shown as a golf cap, a fisherman's hat, a cowboy hat, or any other style of head covering which may benefit from the addition of a chin strap. The portions of packaging card 300 which correspond to said human head, human neck, and a portion of a human torso adjacent to said neck provide a support structure for chin strap 10 and simultaneously presents the invention and illustrates its use.

Packaging card 300 is provided with a plurality of through holes 330, 340, 360, 370, said plurality of through holes 330, 340, 360, 370 being strategically placed upon the packaging card 300 such that when chin strap 10 is mounted within said plurality of through holes 330, 340, 360, 370 chin strap 10 appears to be fixed to the indicia on the front surface 302 of the packaging card 300 in a manner which simulates the appearance of the chin strap 10 in use. Preferably, packaging card 300 is provided with at least two through holes 330, 370. Most preferably, packaging card 300 is provided with four through holes 330, 340, 360, 370.

These four through holes comprise a first through hole 330, a second through hole 340, a third through hole 360, and a fourth through hole 370. First through hole 330 is positioned adjacent to the shaped peripheral edge 304 at the position corresponding to the indicia of the left side of the human face 305 at the position where the indicia of the left side of the human face 305 intersects the indicia of the left side of the baseball cap 350. Second through hole 340 is positioned adjacent to the shaped peripheral edge 304 at the position corresponding to the indicia of the left side of the human neck 310 at the position where the indicia of the left side of the human neck 310 intersects the indicia of the left side of a portion of a human shirt 320. Third through hole 360 is positioned adjacent to the shaped peripheral edge 304 at the position corresponding to the indicia of the right side of the human neck 310 at the position where indicia of the right side of the human neck 310 intersects the indicia of the right side of the portion of a human shirt 320. Fourth through hole 370 is positioned adjacent to the shaped peripheral edge 304 at the position corresponding to the indicia of the right side of the human face 305 at the position where the indicia of the right side of the human face 305 intersects the indicia of the right side of the baseball cap 350.

Slits 332, 342, 362, 372 extend completely through card 300 and join peripheral edge 304 and the respective through holes 330, 340, 360, 370, allowing a preassembled chin strap 10 to be mounted to the card 300. Chin strap 10 is mounted within said plurality of through holes 330, 340, 360, 370 such that the adjustment means, bead 40, is mounted on the front surface 302 of the packaging card 300, and such that clips 80 are mounted on the back surface 303.

Mounting slot 380 is an elongate perforation located adjacent to the upper edge of packaging card 300 which is used to receive a rod style hanger for mounting packaging card 300 on a display rack. Although this is the preferred method for mounting packaging card 300 on a display rack, it is understood that other conventional methods of mounting packaging cards may be substituted for mounting slot 380.

Figure 16:
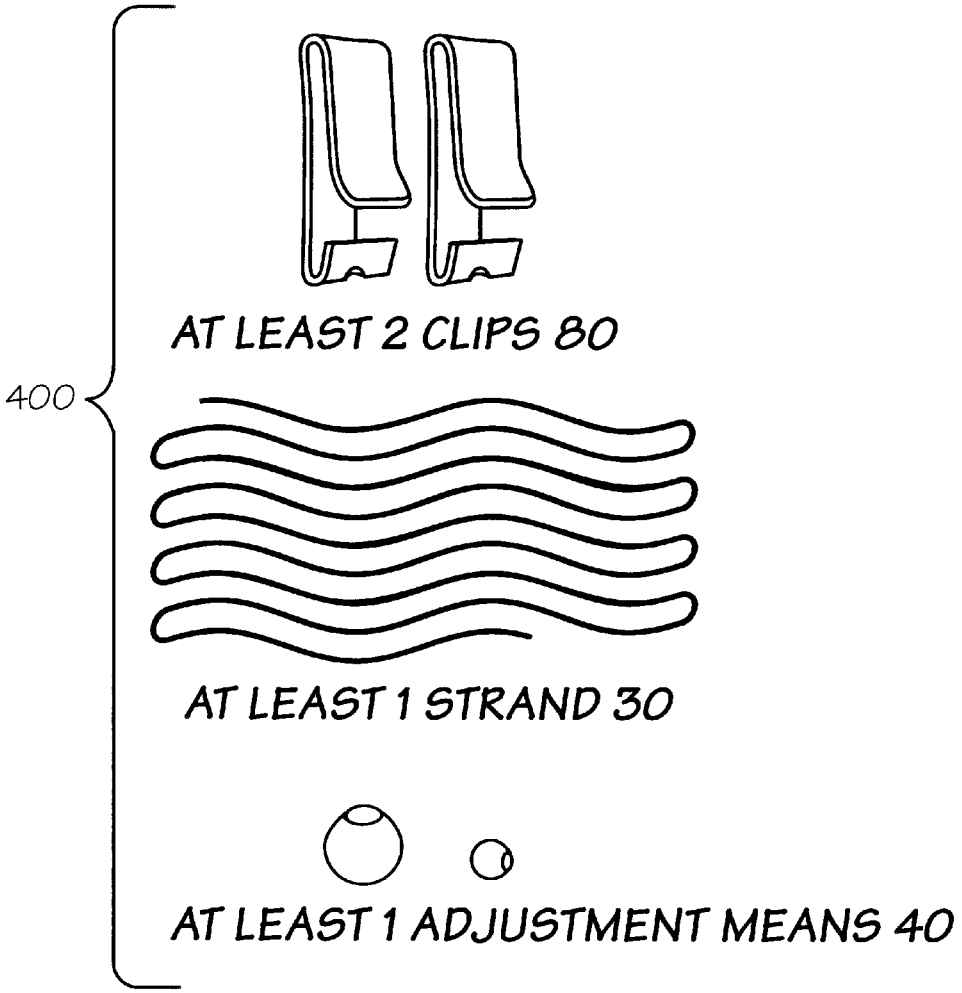
FIG. 16 is an example of the preferred embodiment of a chin strap kit, illustrating the minimum unassembled components which would be included therein.
Figure 17:
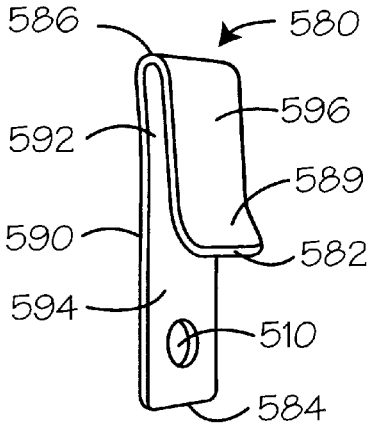
FIG. 17 is a perspective view of an alternative embodiment of a clip for inclusion in a kit.

Chin strap 10 may be provided in unassembled form as a kit for use in craft making. As illustrated in FIG. 16, kit 400 includes at least enough components to form one chin strap. For example, a kit containing the minimum elements would include two clips 80, one strand 30, and one adjustment means 40. Instructions would also be included and would detail assembly of chin strap 10 and the use of household tools to crimp or otherwise secure strand 30 within clips 80. It is also within the scope of the invention to include a crimping tool in kit 400. In the preferred embodiment, kit 400 includes enough components to form at least three chin straps of varying styles. That is, the preferred kit 400 would include at least three pair (or six) clips 80, three strands 30, and three adjustment means 40.

The three strands 30 may be identical, or may be different from each other in color, texture, and or style. For example, kit 400 may include a leather strand, a nylon twine strand, and a metal chain strand, or some other combination of strands formed from suitable materials. The three adjustment means 40 may be identical, or different from each other in color, texture, size, or style. For example, kit 400 may include a single, two-hole bead, two single hole beads, and a bolo-tie type clip, or some other combination of suitable adjustment devices. Different kits 400 would be configured having components of color, sizes, and styles which would appeal to specific consumers. One type of kit would appeal to adolescents while a different kit would appeal to active adults. Additional components may be added to kits which would more clearly appeal to these various consumer groups. Additional components may include, but are not limited to, items for decorating the adjustment means 40 and or clips 80, such as paint, glitter, stickers, sea shells, ribbon, and faux jewels. Additional components may also include, but are not limited to, items for decorating the strand 30 such as charms or faux jewels.

An alternative kit may be provided with a modified clip 580 which does not require a crimping tool. Clip 580, like clip 80, is comprised of an elongate sheet of material, the elongate sheet having a narrow width relative to its length, and a thickness which is small relative to its length and width. The elongate sheet has a first end 584, a second end 582, and a body portion 592 which extends along the length between the first end 584 and the second end 582. The body portion 592 of the elongate sheet is provided with an inner surface 594 and an outer surface 590.

Body portion 592 of clip 80 is formed having a fold 586 adjacent to but spaced apart a distance from the second end 582, the fold 586 resulting in the second end 582 being folded back so as to overlie and confront the inner surface 594 of the body portion 592 to form flange 596, the distance being sized to be approximately that of the second flange 96 of clip 80.

Body portion 592 is provided with a through hole 510 which extends between the inner surface 594 and the outer surface 590. Through hole 510 is located adjacent to first end 584 such that it lies between first end 584 and flange 596, and is dimensioned to fittingly receive one of the respective first or second ends 32, 34 of the strand 30 therethrough. Strand 30 is retained within through hole 510 by knotting the respective first or second ends 32, 34.

Second end 582 of body portion 592 is provided with an outward bend 589 along its entire width such that second end 582 is spaced apart from both the inner surface 594 of the body portion 592 and from the first end 582. Outward bend 589 allows flange 596 to be easily inserted between the interior band 56 and the inner surface 70 of the crown 58 and also serves to guide the free edge 62 of the interior band 56 into the recess between flange 596 and the inner surface 594 of clip 580. When in use, the interior band 56 of cap 50 is maintained between flange 596 and the body portion 592 of clip 580 by means of spring tension. This spring tension results from the slight deflection of flange 596 away from body portion 592 due to the insertion of interior band 56. This spring tension is adequate to fully retain clip 580 on interior band 56, but does not damage or modify cap 50 in any way.

I claim:

1. A combination hat and chin strap, wherein the hat comprises a crown portion, the crown portion being generally hemispherical in shape and having a hollow interior such that the crown portion comprises an interior surface and an exterior surface, the crown portion further comprising an apex and a generally circular base, the crown portion further comprising a band, said band resulting from the inward folding of the peripheral edge of the crown portion such that the band extends toward said apex and overlies and confronts the interior surface of the crown portion adjacent to said base, said band comprising a free edge and a fold edge, wherein said fold edge of said band consists of the portion of said crown portion which corresponds to the folding of the peripheral edge of the crown portion, said fold edge defining said generally circular base, wherein said band terminates within said hollow interior of said crown portion at said free edge, said free edge being adjacent to but spaced apart from said fold edge such that said band has a height, wherein said chin strap comprises an elongate flexible strand having a first end, a second end, and a mid portion which extends between said first end and said second end, said chin strap being secured to said band by means of a clip, wherein two of said clips are used such that a clip is provided for each of said first and second ends, respectively, of said chin strap, said chin strap further comprising a length which allows slack in said strand when said strand is secured to said band by means of said clip.

2. The combination hat and chin strap of claim 1 wherein said chin strap further comprises an adjustment means for adjusting said slack in said strand to the comfort of the wearer.

3. The combination hat and chin strap of claim 2 wherein said adjustment means comprises a primary bead, said primary bead having at least one through hole, said elongate flexible strand extending through said at least one through hole such that said mid portion of said elongate flexible strand resides within said bead.

4. The combination hat and chin strap of claim 3 wherein said adjustment means further comprises a secondary bead, said secondary bead having a secondary bead through hole and said secondary bead having a diameter which is greater than the diameter of said at least one through hole of said primary bead, said primary bead having a single through hole such that when assembled, said elongate flexible strand is inserted through said single through hole of said primary bead in a first direction and then is passed through said secondary bead through hole of said secondary bead, then said elongate flexible strand is then reinserted through said single through hole of said primary bead in a second direction, where the second direction is opposed to the first direction such that said elongate flexible strand is prevented from completely disengaging from said primary bead because of the presence of said secondary bead about said mid portion of said elongate flexible strand.

5. The combination hat and chin strap of claim 2 wherein said adjustment means comprises a bead, said bead having at least two through holes, said elongate flexible strand extending serially through each of said at least two through holes such that said mid portion of said elongate flexible strand resides within said bead.

6. The combination hat and chin strap of claim 2 wherein said adjustment means comprises a primary bead, said primary bead having an exterior surface, said primary bead further comprising indicia formed on the exterior surface thereof.

7. The combination hat and chin strap of claim 2 wherein said elongate flexible strand is comprised of a material selected from the group which includes natural fiber twines synthetic twine, leather, and webbing.

8. The combination hat and chin strap of claim 1 wherein said clip is comprised of an elongate sheet of material, said elongate sheet comprising a narrow width relative to its length, and a thickness which is small relative to its length and width, said elongate sheet comprising a first end, a second end, and a body portion which extends along said length between said first end and said second end, said body portion of said elongate sheet comprising an inner surface and an outer surface, said body portion being provided with a first fold adjacent to but spaced apart a first distance from said first end, said first fold resulting in said first end being folded back so as to overlie and confront said inner surface of said body portion to form a first flange, said body portion being provided with a second fold adjacent to but spaced apart a second distance from said second end, said second fold resulting in said second end being folded back so as to overlie and confront said inner surface of said body portion to form a second flange, said second distance being sized such that said second end abuts said first end, said body portion being provided with a through hole which extends between said inner surface of said body portion and said outer surface of said body portion, said through hole being located in said first fold, said through hole being dimensioned to fittingly receive said elongate flexible strand therethrough.

9. The combination hat and chin strap of claim 8 wherein said first flange is crimped against said inner surface of said body portion such that said elongate flexible strand is permanently retained between said first flange and said inner surface of said body portion.

10. The combination hat and chin strap of claim 9 wherein said first end of said body portion is provided with a bend along its entire width such that said first end is angled toward said inner surface of said body portion.

11. The combination hat and chin strap of claim 10 wherein said second end of said body portion is provided with a bend along its entire width such that said second end is spaced apart from both said inner surface of said body portion and from said first end, said bend in said second end allowing said second flange to be easily inserted between said band and said inner surface of said crown, so that when in use said band of said hat is maintained between said second flange and said body portion of said clip.

12. A strap for retaining head coverings in adjacency to the head, said strap comprising a first clip, a second clip, and a strand portion extending between said first clip and said second clip, wherein each of said first clip and said second clip is provided with a means for securement to a head covering and a means for securement to said strand portion, wherein said strand portion comprises a strand first end, a strand second end, and a strand mid portion which extends between said strand first end and said strand second end, said strand portion further comprising a length which allows slack in said strand portion when said strand portion is secured to said head covering by means of said first clip and said second clip, wherein said strand portion further comprises an adjustment means located in the mid portion thereof for use in adjustment of said slack in said strand portion, wherein each of said first clip and said second clip comprise a hook portion so as to provide said means for securement to a head covering, said hook portion receiving a portion of a head covering therein such the it rests upon the head covering without piercing the head covering so as to support each of said first clip and said second clip and allowing each of said first clip and said second clip to hang from a head covering.

13. The strap of claim 12 wherein means for securement to a head covering comprises a thin strip of rigid material which has been formed into a general U-shape, wherein the general U-shape comprises a first leg and a second leg joined by a base portion, and wherein said base portion is small such that said first leg and said second leg are generally parallel and confronting, and such that a portion of the head covering may be retained therein.

14. The strap of claim 13 wherein said second leg has a length which is greater than said first leg, said second leg comprising a proximal end which abuts said base portion, said second leg comprising a distal end which is opposed to said proximal end, said distal end of said second leg extending beyond said first leg and comprising said means for securement to said strand portion, said means for securement to said strand portion comprising a fold in said distal end of second leg such that said distal end is folded back on itself such that it overlies and confronts itself, said means for securement to said strand portion comprising a through hole in said fold which is sized to receive said strand portion therethrough, said strand comprising a first end, and mid portion, and a second end, said means for securement comprising a first end of said strand extending through said through hole in said fold, and further comprising a crimp in said distal end of said second leg such that said first end of said strand is compressed within said fold and can not be withdrawn from said through hole in said fold.

15. A kit for use in creating a chin strap from individual unassembled components, said kit comprising a plurality of individual components which, when assembled, form said chin strap, said plurality of individual components comprising at least one strand of elongate material, said at least one strand having a first end, a second end, and a mid portion, at least two clips, each of said at least two clips having means for retaining and holding a respective first end and second end of said at least one strand thereon, each of said at least two clips having means for securement to a head covering, and at least one adjustment means, said at least one adjustment means sized and shaped to reside about the mid portion of said at least one strand when said chin strap is assembled, said at least one adjustment means allowing any slack in said at least one strand of elongate material to be adjusted when said chin strap is assembled.

16. The kit of claim 15 wherein said at least one adjustment means comprises a primary bead, said primary bead having at least one through hole, said at least one strand extending through each of said at least one through hole such that said mid portion of said at least one strand resides within said primary bead.

17. The kit of claim 16 wherein said at least one adjustment means further comprises a secondary bead, said secondary bead having a secondary bead through hole and said secondary bead having a diameter which is greater than the diameter of said at least one through hole of said primary bead, said primary bead having a single through hole such that when assembled, said at least one strand is inserted through said single through hole of said primary bead in a first direction and then is passed through said secondary bead through hole of said secondary bead, then said at least one strand is then reinserted through said single through hole of said primary bead in a second direction, where the second direction is opposed to the first direction such that said at least one strand is prevented from completely disengaging from said primary bead because of the presence of said secondary bead about said mid portion of said at least one strand.

18. The kit of claim 15 wherein said at least one adjustment means comprises a bead, said bead having at least two through holes, said at least one strand extending serially through each of said at least two through holes such that said mid portion of said at least one strand resides within said bead.

19. The kit of claim 15 wherein each of said at least two clips is comprised of an elongate sheet of material, said elongate sheet comprising a narrow width relative to its length, and a thickness which is small relative to its length and width, said elongate sheet comprising a first end, a second end, and a body portion which extends along said length between said first end and said second end, said body portion of said elongate sheet comprising an inner surface and an outer surface, said body portion being provided with a first fold adjacent to but spaced apart a first distance from said first end, said first fold resulting in said first end being folded back so as to overlie and confront said inner surface of said body portion to form a first flange, said body portion being provided with a second fold adjacent to but spaced apart a second distance from said second end, said second fold resulting in said second end being folded back so as to overlie and confront said inner surface of said body portion to form a second flange, said second distance being sized such that said second end abuts said first end, said body portion being provided with a through hole which extends between said inner surface of said body portion and said outer surface of said body portion, said through hole being located in said first fold, said through hole being dimensioned to fittingly receive said strand therethrough.

20. The kit of claim 15 wherein each of said at least two clips is comprised of an elongate sheet of material, said elongate sheet comprising a narrow width relative to its length, and a thickness which is small relative to its length and width, said elongate sheet comprising a first end, a second end, and a body portion which extends along said length between said first end and said second end, said body portion of said elongate sheet comprising an inner surface and an outer surface, said body portion being provided with a fold adjacent to but spaced apart a first distance from said second end, said fold resulting in said second end being folded back so as to overlie and confront said inner surface of said body portion to form a flange, said first distance being sized to allow said first end to extend beyond said second end, said body portion provided with a through hole which extends between the inner surface and the outer surface, said through hole being located adjacent first end such that it lies between first end and said flange, and said through hole being dimensioned to fittingly receive one of the respective first or second ends of the at least one strand therethrough.

21. A strap for retaining head coverings in adjacency to the head, said strap comprising a first clip, a second clip, and a strand portion extending between said first clip and said second clip, wherein each of said first clip and said second clip is provided with a means for securement to a head covering and a means for:securement to said strand portion, wherein said strand portion comprises a strand first end, a strand second end, and a strand mid portion which extends between said strand first end and said strand second end, said strand portion further comprising a length which allows slack in said strand portion when said strand portion is secured to said head covering by means of said first clip and said second clip, wherein said strand portion further comprises an adjustment means located in the mid portion thereof for use in adjustment of said slack in said strand portion, and wherein means for securement to a head covering comprises a thin strip of rigid material which has been formed into a general U-shape, wherein the general U-shape comprises a first leg and a second leg joined by a base portion, and wherein said base portion is small such that said first leg and said second leg are generally parallel and confronting, and such that a portion of the head covering may be retained therein.

22. The strap of claim 21 wherein said second leg has a length which is greater than said first leg, said second leg comprising a proximal end which abuts said base portion, said second leg comprising a distal end which is opposed to said proximal end, said distal end of said second leg extending beyond said first leg and comprising said means for securement to said strand portion, said means for securement to said strand portion comprising a fold in said distal end of second leg such that said distal end is folded back on itself such that it overlies and confronts itself, said means for securement to said strand portion comprising a through hole in said fold which is sized to receive said strand portion therethrough, said strand comprising a first end, and mid portion, and a second end, said means for securement comprising a first end of said strand extending through said through hole in said fold, and further comprising a crimp in said distal end of said second leg such that said first end of said strand is compressed within said fold and can not be withdrawn from said through hole in said fold.

23. A kit for use in creating a chin strap from individual unassembled components, said kit comprising a plurality of individual components which, when assembled, form said chin strap, said plurality of individual components comprising at least one strand of elongate material, said at least one strand having a first end, a second end, and a mid portion, at least two clips, each of said at least two clips having means for retaining and holding a respective first end and second end of said at least one strand thereon, each of said at least two clips having means for securement to a head covering, at least one adjustment means, said at least one adjustment means sized and shaped to reside about the mid portion of said at least one strand when said chin strap is assembled, said at least one adjustment means allowing any slack in said at least one strand of elongate material to be adjusted when said chin strap is assembled, wherein said at least one adjustment means comprises a primary bead, said primary bead having at least one through hole, said at least one strand extending through each of said at least one through hole such that said mid portion of said at least one strand resides within said primary bead, wherein said at least one adjustment means further comprises a secondary bead, said secondary bead having a secondary bead through hole and said secondary bead having a diameter which is greater than the diameter of said at least one through hole of said primary bead, said primary bead having a single through hole such that when assembled, said at least one strand is inserted through said single through hole of said primary bead in a first direction and then is passed through said secondary bead through hole of said secondary bead, then said at least one strand is then reinserted through said single through hole of said primary bead in a second direction, where the second direction is opposed to the first direction such that said at least one strand is prevented from completely disengaging from said primary bead because of the presence of said secondary bead about said mid portion of said at least one strand.

24. A kit for use in creating a chin strap from individual unassembled components, said kit comprising a plurality of individual components which, when assembled, form said chin strap, said plurality of individual components comprising at least one strand of elongate material, said at least one strand having a first end, a second end, and a mid portion, at least two clips, each of said at least two clips having means for retaining and holding a respective first end and second end of said at least one strand thereon, each of said at least two clips having means for securement to a head covering, and at least one adjustment means, said at least one adjustment means sized and shaped to reside about the mid portion of said at least one strand when said chin strap is assembled, said at least one adjustment means allowing any slack in said at least one strand of elongate material to be adjusted when said chin strap is assembled, wherein each of said at least two clips is comprised of an elongate sheet of material, said elongate sheet comprising a narrow width relative to its length, and a thickness which is small relative to its length and width, said elongate sheet comprising a first end, a second end, and a body portion which extends along said length between said first end and said second end, said body portion of said elongate sheet comprising an inner surface and an outer surface, said body portion being provided with a first fold adjacent to but spaced apart a first distance from said first end, said first fold resulting in said first end being folded back so as to overlie and confront said inner surface of said body portion to form a first flange, said body portion being provided with a second fold adjacent to but spaced apart a second distance from said second end, said second fold resulting in said second end being folded back so as to overlie and confront said inner surface of said body portion to form a second flange, said second distance being sized such that said second end abuts said first end, said body portion being provided with a through hole which extends between said inner surface of said body portion and said outer surface of said body portion, said through hole being located in said first fold, said through hole being dimensioned to fittingly receive said strand therethrough.

25. A kit for use in creating a chin strap from individual unassembled components, said kit comprising a plurality of individual components which, when assembled, form said chin strap, said plurality of individual components comprising at least one strand of elongate material, said at least one strand having a first end, a second end, and a mid portion, at least two clips, each of said at least two clips having means for retaining and holding a respective first end and second end of said at least one strand thereon, each of said at least two clips having means for securement to a head covering, and at least one adjustment means, said at least one adjustment means sized and shaped to reside about the mid portion of said at least one strand when said chin strap is assembled, said at least one adjustment means allowing any slack in said at least one strand of elongate material to be adjusted when said chin strap is assembled, wherein each of said at least two clips is comprised of an elongate sheet of material, said elongate sheet comprising a narrow width relative to its length, and a thickness which is small relative to its length and width, said elongate sheet comprising a first end, a second end, and a body portion which extends along said length between said first end and said second end, said body portion of said elongate sheet comprising an inner surface and an outer surface, said body portion being provided with a fold adjacent to but spaced apart a first distance from said second end, said fold resulting in said second end being folded back so as to overlie and confront said inner surface of said body portion to form a flange, said first distance being sized to allow said first end to extend beyond said second end, said body portion provided with a through hole which extends between the inner surface and the outer surface, said through hole being located adjacent first end such that it lies between first end and said flange, and said through hole being dimensioned to fittingly receive one of the respective first or second ends of the at least one strand therethrough.

26. A kit for use in creating a chin strap from individual unassembled components, said kit comprising a plurality of individual components which, when assembled, form said chin strap, said plurality of individual components comprising at least one strand of elongate material, said at least one strand having a first end, a second end, and a mid portion, at least two clips, each of said at least two clips having means for retaining and holding a respective first end and second end of said at least one strand thereon, each of said at least two clips having means for securement to a head covering, each of said at least two clips comprise a hook portion so as to provide said means for securement to a head covering, said hook portion allowing each of said first clip and said second clip to hang from a head covering, and at least one adjustment means, said at least one adjustment means sized and shaped to reside about the mid portion of said at least one strand when said chin strap is assembled, said at least one adjustment means allowing any slack in said at least one strand of elongate material to be adjusted when said chin strap is assembled.

27. A combination hat and chin strap, wherein the hat comprises a crown portion, the crown portion being generally hemispherical in shape and having a hollow interior such that the crown portion comprises an interior surface and an exterior surface, the crown portion further comprising an apex and a generally circular base, the crown portion further comprising a band, said band resulting from the inward folding of the peripheral edge of the crown portion such that the band extends toward said apex and overlies and confronts the interior surface of the crown portion adjacent to said base, said band comprising a free edge and a fold edge, wherein said fold edge of said band consists of the portion of said crown portion which corresponds to the folding of the peripheral edge of the crown portion, said fold edge defining said generally circular base, wherein said band terminates within said hollow interior of said crown portion at said free edge, said free edge being adjacent to but spaced apart from said fold edge such that said band has a height, wherein said chin strap comprises an elongate flexible strand having a first end and a second end, said chin strap being secured to said band by means of a clip, wherein two of said clips are used such that a clip is provided for each of said first and second ends, respectively, of said chin strap, said chin strap further comprising a length which allows slack in said strand when said strand is secured to said band by means of said clip.

28. The combination hat and chin strap of claim 27 wherein the elongate flexible strand is a single, continuous element, the elongate flexible strand comprising a mid portion which extends between said first end and said second end.

29. The combination hat and chin strap of claim 28 wherein said chin strap further comprises an adjustment means for adjusting said slack in said elongate flexible strand to the comfort of the wearer.

* * * * *